United States Patent [19]

Mura

[11] 4,007,724

[45] Feb. 15, 1977

[54] C. D. IGNITION SYSTEM WITH NOISE REJECTION MEANS

[75] Inventor: Richard J. Mura, Kenosha, Wis.

[73] Assignee: Outboard Marine Corporation, Waukegan, Ill.

[22] Filed: Nov. 21, 1975

[21] Appl. No.: 634,072

[52] U.S. Cl. ..... 123/148 CC; 123/148 E

[51] Int. Cl.[2] ..... F02P 1/00

[58] Field of Search ..... 123/148 DS, 148 CC, 123/148 E

[56] References Cited

UNITED STATES PATENTS

| | | | |
|---|---|---|---|
| 3,715,650 | 2/1973 | Draxler | 123/148 CC |
| 3,805,759 | 4/1974 | Fitzner | 123/148 CC |
| 3,809,044 | 5/1974 | Jereb et al. | 123/148 CC |
| 3,828,753 | 8/1974 | Reddy | 123/148 CC |
| 3,861,372 | 1/1975 | Shibukawa et al. | 123/148 CC |
| 3,891,524 | 7/1975 | Burkett et al. | 123/148 CC |
| 3,937,200 | 2/1976 | Sleder et al. | 123/148 CC |

*Primary Examiner*—Charles J. Myhre
*Assistant Examiner*—Paul Devinsky
*Attorney, Agent, or Firm*—Michael, Best & Friedrich

[57] ABSTRACT

Disclosed herein is an engine ignition system comprising a charge capacitor which is periodically charged, first and second ignition coils respectively including first and second primary windings and first and second secondary windings connected respectively to first and second spark plugs, first and second electronic switches respectively including first and second anodes connected respectively to the first and second primary windings, first and second cathodes connected to the charge capacitor, and first and second control elements operable, upon application thereto of a trigger pulse, to cause the first and second switches to be conductive, a relatively rotatable magnet and coil for generating trigger pulses in response to engine rotation, which coil has first and second ends respectively connected to the first and second control elements, and means for preventing false triggering of the switches comprising a second capacitor having a first plate connected to the first and second cathodes and having a second plate, a resistor having a first end connected to the first and second cathodes in parallel with the connection of the first plate of the second capacitor to the first and second cathodes, which resistor has a second end, a first diode having an anode connected to the second plate of the second capacitor and to the second end of the resistor and a cathode connected to and between the first end of the coil and the first control element, and a second diode having an anode connected to the second plate of the second capacitor and to the second end of the resistor, and a cathode connected to and between the second end of the coil and the second control element.

6 Claims, 2 Drawing Figures

C. D. IGNITION SYSTEM WITH NOISE REJECTION MEANS

BACKGROUND OF THE INVENTION

The invention relates generally to ignition systems for internal combustion engines.

More particularly, the invention relates to capacitor discharge ignition system for internal combustion engines and even more particularly to engines having two cylinders.

Attention is directed to U.S. Pat. No. 3,805,759 issued Apr. 23, 1974, which discloses a two cylinder engine ignition circuit directed to elimination of undesirable spark advance.

SUMMARY OF THE INVENTION

The invention provides an engine ignition system comprising a charge capacitor, means for periodically charging the capacitor, first and second ignition coils respectively including first and second primary windings and first and second secondary windings connected respectively to the first and second spark plugs, first and second electronic switches respectively including first and second anodes connected respectively to the first and second primary windings, first and second cathodes connected to the charge capacitor, and first and second control elements operable, upon application thereto of a trigger pulse to cause the first and second switches to be conductive, means including a relatively rotatable magnet and coil for generating trigger pulses in response to engine rotation, which coil has first and second ends respectively connected to the first and second control elements, and means for preventing false triggering of said switches comprising a second capacitor having a first plate connected to the first and second cathodes and having a second plate, a resistor having a first end connected to the first and second cathodes in parallel withthe connection of the first plate of the second capacitor to the first and second cathodes, which resistor has a second end, a first diode having an anode connected to the second plate of the second capacitor and to the second end of the resistor and a cathode connected to and between the first end of the coil and the first control element, and a second diode having an anode connected to the second plate of the second capacitor and to the second end of the resistor, and a cathode connected to and between the second end of the coil and the second control element.

The invention also privides an engine ignition system comprising a charge capacitor, means for periodically charging the capacitor, an ignition coil including a primary winding and a secondary winding connected to a spark plug, an electronic switch including an anode connected to the primary winding, a cathode connected to the charge capacitor, and a control element operable, upon application thereto of a trigger pulse, to cause the electronic switch to be conductive, means including a relatively rotatable magnet and trigger coil for generating trigger pulses in response to engine rotation and including a trigger coil having a first end connected to the control element and a second end, means for preventing false triggering of the electronic switch comprising a second capacitor having a first plate connected to the charge capacitor in parallel with connection of the cathode to the charge capacitor and having a second plate, a first resistor having a first end connected to the charge capacitor in parallel with the connection of the cathode and of the first plate of the second capacitor to the charge capacitor and having a second end, a first diode having an anode connected to the second plate of the second capacitor and to the second end of the first resistor and a cathode connected to and between the first end of the trigger coil and the control element, and a second diode having an anode connected to the second plate of the second capacitor and to the second end of the first resistor, and a cathode connected to the second end of the trigger coil, and a second resistor having a first end connected to the second end of the trigger coil and to the cathode of the second diode and having a second end connected to the charge capacitor in parallel with the connection of the first plate of the second capacitor, the first end of the first resistor, and the cathode of the electronic switch.

One of the principal features of the invention is the provision of an ignition circuit which is operable to prevent such false triggering as sometimes otherwise occurs with increasing engine speed.

Another principal feature of the invention is the provision of a two cylinder engine ignition circuit which operates to prevent such false triggering as sometimes otherwise occurs with increasing engine speed.

Other features and advantages of the embodiments of the invention will become known by reference to the following drawings, general description and appended claims.

THE DRAWINGS

Figure 1:
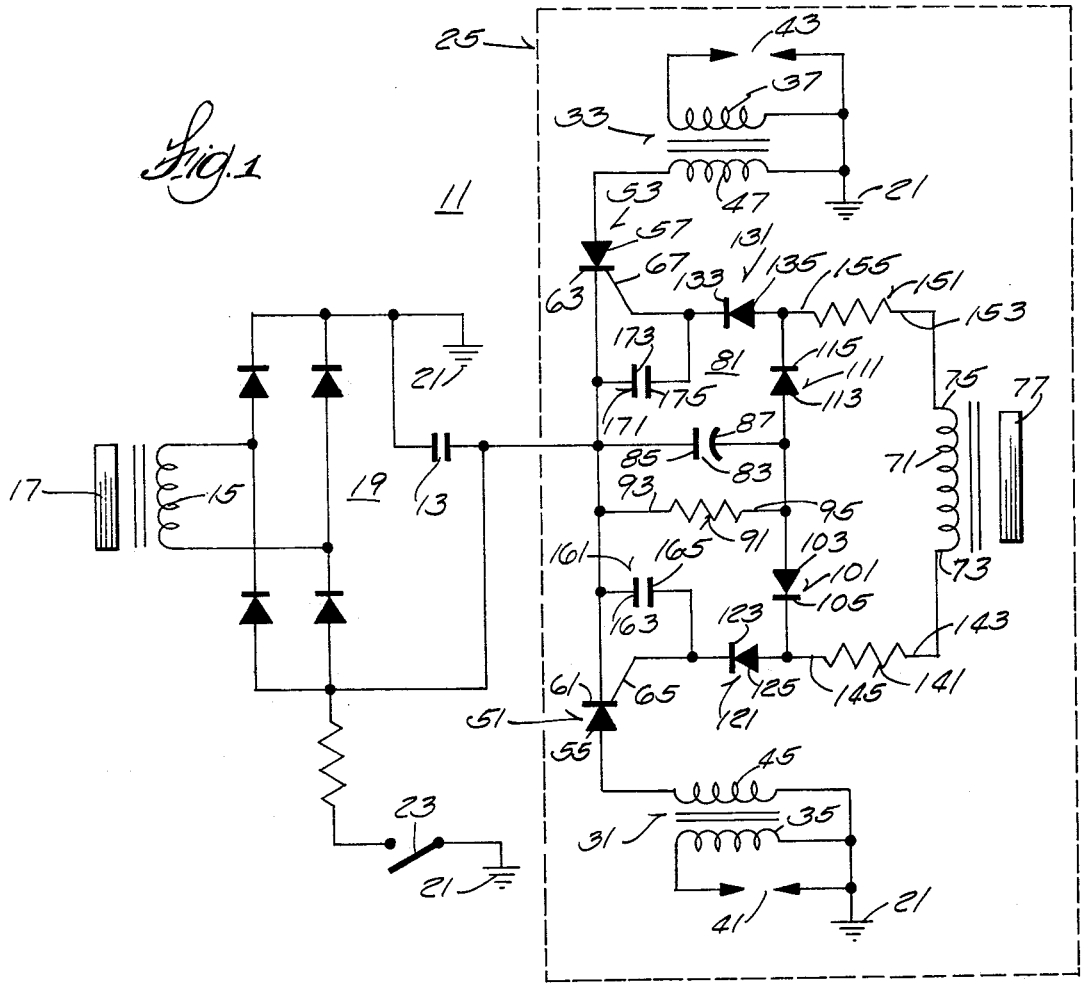
FIG. 1 is a schematic diagram of an ignition circuit embodying various of the features of the invention.

Before explaining the embodiments of the invention in detail, it is to be understood that the invention is not limited in its application to the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

GENERAL DESCRIPTION

The ignition circuit 11 shown in FIG. 1 is particularly adapted for operating a two cylinder internal combustion engine (not shown) and includes a charge capacitor 13, together with means for periodically charging the capacitor. Any suitable means can be employed for charging the capacitor. In the illustrated construction such charging means comprises a coil 15 and a magnet 17 which is rotated by the engine past the coil 15. In turn, the coil 15 is connected to a suitable rectifying bridge 19 which, in turn, is connected, as shown in FIG. 1, to the plates of the capacitor 13. The bridge 19 is also connected, as shown in FIG. 1, to ground 21 and to a shorting or "kill" switch 23 connected to ground 21. The foregoing is well known in the art.

The ignition circuit 11 further includes a trigger subcircuit 25 comprising first and second ignition coils 31 and 33 respectively including first and second secondary windings 35 and 37 respectively connected, at one end, to first and second spark plugs 41 and 43 and respectively connected, at the other end, to ground 21 and to one end of respective first and second primary windings 45 and 47. The other ends of the first and second primary windings 45 and 47 are respectively connected to first and second electronic switches 51 and 53 which, in turn, are connected to the charge capacitor 13.

Preferably, the first and second electronic switches 51 and 53 comprise first and second SCR's respectively having first and second anodes 55 and 57 respectively connected to the first and second primary windings 45 and 47, first and second cathodes 61 and 63 connected to the charge capacitor 13, and first and second control elements 65 and 65 operable, upon application of a trigger pulse, to respectively cause the first and second switches 51 and 53 to be conductive.

Means are provided for triggering the switches 51 and 53 to cause spark generation at the spark plugs 41 and 43. Various arrangements are possible. In the illustrated construction, such means comprises a sensor or trigger coil 71 having first and second ends 73 and 75 respectively connected to the first and second control elements 65 and 67 and a magnet 77 which is rotatable by the engine relative to the sensor coil 71 to provide successive trigger pulses of opposite polarity. Preferably, the pulse generating magnet and coil 77 and 71 are constructed, as shown in the Cavil U.S. Pat. No. 3,646,377 issued Feb. 29, 1972, which is incorporated herein by reference, so as to provide sharp pulses which are produced at a substantially constant position of the pistion in the cylinder regardless of the rate of engine rotation.

In order to avoid false triggering of the switches 51 and 53 in response to stray pulses which can sometimes occur, particularly with increasing engine speed, the sub-circuit 25 also includes a network 81 comprising a second capacitor 83 having a first plate 85 connected to the first and second cathodes 61 and 63 of the switches 51 and 53 and to the charge capacitor 13. In addition, the second capacitor 83 includes a second plate 87.

The capacitor 83 serves, in cooperation with the other components of the network 81, to establish an increased operating voltage level below which stray pulses will be ineffective to cause conduction of the switches. In operation, the capacitor 83 is variably charged in response to current flow in the gate and cathode path of the switches 51 and 53. Thus the operating voltage level rises and falls with increasing and decreasing speed.

The network 81 also includes a resistor 91 having one end 93 connected to the first and second cathodes 61 and 63 of the switches 51 and 53 and to the charge capacitor 13 in parallel with the connection thereto of the first plate 85 of the second capacitor 81. In addition, the resistor 91 includes a second end 95.

The resistor 91 provides a discharge path for the second capacitor 83 such that the level of blocking voltage on the control elements floats up with increasing speed and down with decreasing speed, thus masking out unwanted noise pulses which tend to also increase and decrease with speed.

The network further includes a first diode 101 having an anode 103 connected to the second plate 87 of the second capacitor 83 and to the second end 95 of the resistor 91 and a cathode 105 connected to and between the first end 73 of the sensor coil 71 and the control element 65 of the first switch 51.

The network 81 also includes a second diode 111 having an anode 113 connected to the second plate 87 of the second capacitor 83 and to the second end 95 of the resistor 91 and having a cathode 115 connected to and between the second end 75 of the sensor coil 71 and the control element 67 of the second switch 53.

Preferably, the circuit 11 further includes a third diode 121 connected between the control element 65 of the first switch 51 and the first diode 101 and the first end 73 of the sensor coil 71. More particularly, the third diode 121 includes a cathode 123 connected to the control element 65 of the first switch 51 and an anode 125 connected to he cathode 105 of the first diode 101 and to the first end 73 of the sensor coil 71.

In addition, the circuit 11 further includes a fourth diode 131 connected between the control element 67 of the second switch 53 and the second diode 111 and the second end 75 of the sensor coil 71. More particularly, the fourth diode 131 includes a cathode 133 connected to the control element 67 of the second switch 53 and an anode 135 connected to the cathode 115 of the second diode 111 and to the second end 75 of the sensor coil 71.

Preferably, the circuit 11 further includes a second resistor 141 having one end 143 connected to the first end 73 of the sensor coil 71 and having a second end 145 connected to the cathode 105 of the first diode 101 and to the anode 125 of the third diode 121. In addition, the circuit preferably includes a third resistor 151 having a first end 153 connected to the second end 75 of the sensor coil 71 and a second end 155 connected to the cathode 115 of the second diode 111 and to the anode 135 of the fourth diode.

The circuit preferably also includes a third capacitor 161 having one plate 163 connected to the cathode 61 of the first switch 51 and having a second plate 165 connected to the control element 65 of the first switch 51. In addition, the circuit 11 preferably includes a fourth capacitor 171 having one plate 173 connected to the cathode 63 of the second switch 53 and a second plate 175 connected to the control element 67 of the second switch 53.

The capacitor 161 and 171 provide low impedence paths for masked noise pulses and thus assist in preventing conduction by the switches.

In operation, as engine speed increases, the potential of the pulse generated by the sensor coil 71 increases and consequently, a charge builds upon the first plate of the second capacitor 83. This charge on the capacitor 83 has the effect of requiring a pulse of greater potential to effect conduction by the switches 51 and 53. Accordingly, in effect, the potential needed to render the switches 51 and 53 conductive is increased as the engine speed increases so as to exclude false triggering by stray pulses. As already indicated, and because the disclosed circuit is preferably used with a pulse generator of the type disclosed in the Cavil U.S. Pat. No. 3,646,377 issued Feb. 29, 1972, the circuit does not effect the time when the switches 51 and 53 are actuated to effect conduction and to thereby effect spark generation.

Figure 2:
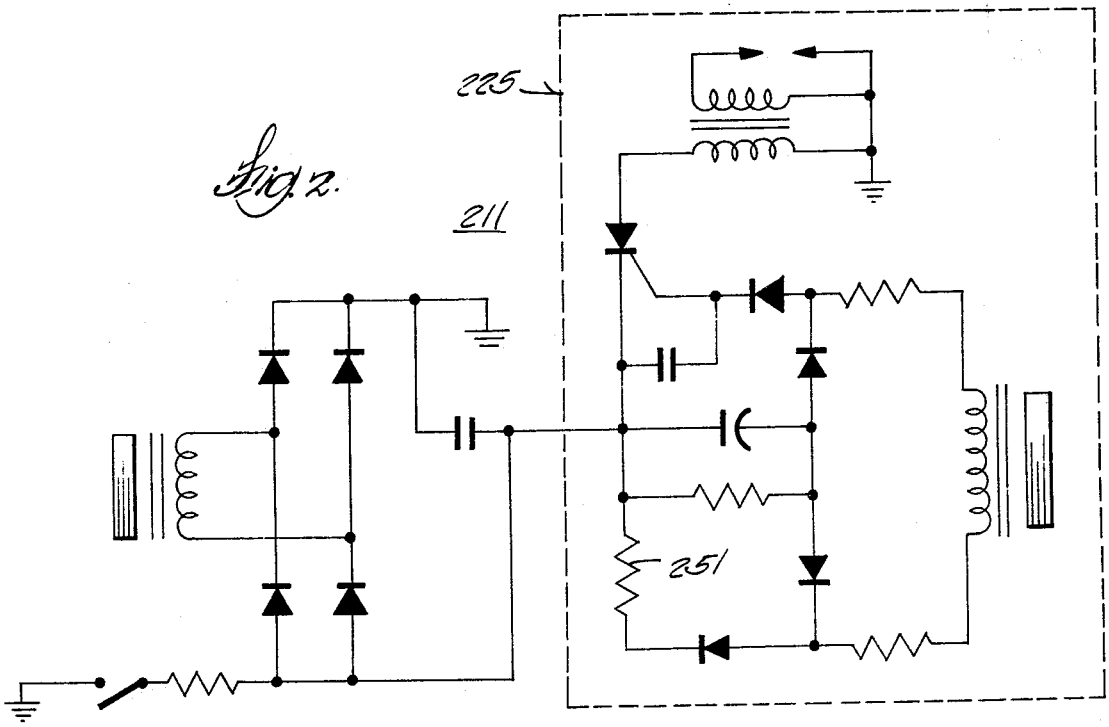
FIG. 2 is a schematic diagram of another ignition circuit embodying various of the features of the invention.

The disclosed circuit 11 can be used with a one cylinder engine by omitting use of one of the ignition coils 31 or 33 and the associated spark plug 41 or 43 and by replacing the associated switch 51 or 53 with a resistor. More particularly, shown in FIG. 2 is another circuit 211 which is similar to the circuit 11 shown in FIG. 1, except that, in the triggering sub-circuit 225, the ignition coil 31 and spark plug 41 have been omitted and the switch 51 and capacitor 161 have been replaced with a resistor 251 which can be of approximately 150 ohms. As the circuit 211 is otherwise the same as that shown in FIG. 1, no further description is necessary.

In the circuits 11 and 211, the magnet 77 associated with the trigger coil 71 is preferably constructed, as already mentioned, in accordance with the teaching of the Cavil U.S. Pat. No. 3,646,377 issued Feb. 29, 1972, so as to include two oppositely polarized arcuately extending magnet parts (not shown). If desired, a magnet comprising a single magnet part with oppositely polarized ends can be employed. Such a magnet would generate in the trigger coil 71 a series of pulses having, in sequence, a first minor pulse of one polarity, a sharp major pulse which is of the other polarity and which has a greater potential than the minor pulse, and a second minor pulse which is of the first polarity and which has a potential less than the major pulse. In this event, when used with the circuit 11 or 211, only the major pulse would be effective to trigger the switch 63 and the minor pulses would, in effect, become false pulses which would be ineffective to trigger because of the build up of potential on the capacitor 83 occurring in response to the major pulse.

If desired, the single trigger magnet with oppositely polarized ends can also be used with a multicylinder engine if individual triggering sub-circuits 225 as shown in FIG. 2 are employed for each cylinder, and if the charging means is effective to charge the capacitor 13 prior to each discharge of the respective triggering sub-circuits.

Various of the features of the invention are set forth in the following claims.

What is claimed is:

1. An engine ignition system comprising a charge capacitor, means for periodically charging said capacitor, first and second ignition coils respectively including first and second primary windings and first and seciond secondary windings connected respectively to first and second spark plugs, first and second electronic switches respectively including first and second anodes connected respectively to said first and second primary windings, first and second cathodes connected to said charge capacitor, and first and second control elements operable, upon application thereto of a trigger pulse, to cause said first and second switches to be conductive, means including a relatively rotatable magnet and coil for generating trigger pulses in response to engine rotation, said coil having first and second ends respectively connected to said first and second control elements, and means for preventing false triggering of said switches comprising a second capacitor having a first plate connected to said first and second cathodes and having a second plate, a resistor having a first end connected to said first and second cathodes in parallel with the connection of the first plate of said second capacitor to said first and second cathodes, said resistor having a second end, a first diode having an anode connected to said second plate of said second capacitor and to said second end of said resistor and a cathode connected to and between said first end of said coil and said first control element, and a second diode having an anode connected to said second plate of said second capacitor and to said second end of said resistor, and a cathode connected to and between said second end of said coil and said second control element.

2. An engine ignition system in accordance with claim 1 including a third diode having a cathode connected to said first control element and an anode connected to said first end of said coil and to said cathode of said first diode and a fourth diode having a cathode connected to said second control element and an anode connected to said second end of said coil and to said cathode of said second diode.

3. An engine ignition system in accordance with claim 2 and further including a third capacitor connected to said first control element and to said cathode of said first switch and a fourth capacitor connected to said second control element and to said cathode of said second switch.

4. An engine ignition system in accordance with claim 2 including a second resistor having a first end connected to said first end of said coil and a second end connected to said cathode of said first diode and to said anode of said third diode and a third resistor having a first end connected to said second end of said coil and having a second end connected to said cathode of said second diode and to said anode of said fourth diode.

5. An engine ignition system comprising a charge capacitor, means for periodically charging said capacitor, first and second ignition coils respectively including first and second primary windings and first and second secondary windings connected respectively to first and second spark plugs, first and second electronic switches respectively including first and second anodes connected respectively to said first and second primary windings, first and second cathodes connected to said charge capacitor, and first and second control elements operable, upon application thereto of a trigger pulse, to cause said first and second switches to be conductive, a second capacitor having a first plate connected to said first and second cathodes and having a second plate, a first resistor having a first end connected to said first and second cathodes in parallel with the connection of said first plate of said second capacitor to said first and second cathodes, said resistor having a second end, a first diode having a cathode connected to said first control element and an anode, a second diode having a cathode connected to said second control element, and an anode, a third diode having a cathode connected to said anode of first diode and an anode connected to said second plate of said second capacitor and to said second end of said first resistor, a fourth diode having a cathode connected to said anode of said second diode and an anode connected to second plate of said second capacitor and to said second end of said first resistor, a second resistor having a first end connected to said cathode of said third diode and to said anode of said first diode and having a second end, a third resistor having a first end connected to said cathode of said fourth diode and to said anode of said second diode, and means including a relatively rotatable magnet and coil for generating trigger pulses in response to engine rotation, said coil having first and second ends respectively connected to said second ends of said second and third resistors.

6. An engine ignition system comprising a charge capacitor, means for periodically charging said capacitor, an ignition coil including a primary winding and a secondary winding connected to a spark plug, an electronic switch including an anode connected to said primary winding, a cathode connected to said charge capacitor, and a control element operable, upon application thereto of a trigger pulse, to cause said electronic switch to be conductive, means including a relatively rotatable magnet and trigger coil for generating trigger pulses in response to engine rotation, said trigger coil having a first end connected to said control element and having a second end, means for preventing false triggering of said electronic switch comprising a second capacitor having a first plate connected to said charge capacitor in parallel with connection of said cathode to said charge capacitor and having a second plate, a first resistor having a first end connected to said charge capacitor in parallel with the connection of said cathode and of said first plate of said second capacitor to said charge capacitor, said first resistor having a second end, a first diode having an anode connected to said second plate of said second capacitor and to said second end of said first resistor and a cathode connected to and between said first end of said trigger coil and said control element, and a second diode having an anode connected to said second plate of said second capacitor and to said second end of said first resistor, and a cathode connected to said second end of said trigger coil, and a second resistor having a first end connected to said second end of said trigger coil and to said cathode of said second diode and having a second end connected to said charge capacitor in parallel with the connection of said first plate of said second capacitor, said first end of said first resistor, and said cathode of said switch.

* * * * *